US011361700B2

(12) United States Patent
Liu et al.

(10) Patent No.: US 11,361,700 B2
(45) Date of Patent: Jun. 14, 2022

(54) DRIVING CHIP, METHOD OF DRIVING DISPLAY PANEL, DRIVING DEVICE, AND DISPLAY DEVICE

(71) Applicants: BEIJING BOE OPTOELECTRONICS TECHNOLOGY CO., LTD., Beijing (CN); BOE TECHNOLOGY GROUP CO., LTD., Beijing (CN)

(72) Inventors: Rui Liu, Beijing (CN); Wei Sun, Beijing (CN)

(73) Assignees: BEIJING BOE OPTOELECTRONICS TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 348 days.

(21) Appl. No.: 16/489,956

(22) PCT Filed: Jan. 3, 2019

(86) PCT No.: PCT/CN2019/070178
§ 371 (c)(1),
(2) Date: Aug. 29, 2019

(87) PCT Pub. No.: WO2019/223330
PCT Pub. Date: Nov. 28, 2019

(65) Prior Publication Data

US 2021/0335192 A1 Oct. 28, 2021

(30) Foreign Application Priority Data

May 25, 2018 (CN) ..... 201810516127.7

(51) Int. Cl.
*G09G 3/20* (2006.01)

(52) U.S. Cl.
CPC ..... *G09G 3/2074* (2013.01); *G09G 3/20* (2013.01); *G09G 3/2003* (2013.01);
(Continued)

(58) Field of Classification Search
CPC .. G09G 3/2074; G09G 3/2077; G09G 3/2003; G09G 3/3611; G09G 3/3648;
(Continued)

(56) References Cited

U.S. PATENT DOCUMENTS 7,982,702 B2 * 7/2011 Kamada ..... G02F 1/133753 345/89
8,576,257 B2 * 11/2013 Kiya ..... G09G 3/3685 345/690
(Continued)

FOREIGN PATENT DOCUMENTS

CN 107526201 A 12/2017
CN 107610143 A 1/2018
(Continued)

OTHER PUBLICATIONS

First Office Action for Chinese Application No. 201810516127.7, dated Apr. 29, 2019, 7 Pages.
International Search Report and Written Opinion for Application No. PCT/CN2019/070178, dated ,Mar. 29, 2019, 12 Pages.

*Primary Examiner* — Vijay Shankar
(74) *Attorney, Agent, or Firm* — Brooks Kushman P.C.

(57) ABSTRACT

A driving chip for a display panel is provided. The display panel includes a plurality of subpixels arranged at a display region, the display region is provided with a boundary extended by a non-straight line, and the plurality of subpixels includes first subpixels separated from the boundary by a distance substantially smaller than a predetermined threshold and second subpixels other than the first subpixels. The driving chip includes: an adjustment circuit configured to, when the display panel is in a predetermined display mode,
(Continued)

adjust a first grayscale value of at least a part of the first subpixels in original image data into a second grayscale value substantially smaller than the first grayscale value; a driving circuit configured to drive the at least a part of first subpixels in accordance with the second grayscale value to display an image.

20 Claims, 5 Drawing Sheets

(52) U.S. Cl.
CPC ..... *G09G 2300/0443* (2013.01); *G09G 2310/0232* (2013.01); *G09G 2320/0276* (2013.01)

(58) Field of Classification Search
CPC ... G09G 2300/0443; G09G 2310/0232; G09G 2320/0276
See application file for complete search history.

(56) References Cited

U.S. PATENT DOCUMENTS

| | | | | |
|---|---|---|---|---|
| 10,325,545 | B2 * | 6/2019 | Zheng | G09G 3/207 |
| 10,825,375 | B1 * | 11/2020 | Lin | G09G 3/36 |
| 2008/0001869 | A1 | 1/2008 | Chung et al. | |
| 2009/0096816 | A1 * | 4/2009 | Kamijo | G09G 3/3688 345/690 |
| 2018/0130397 | A1 | 5/2018 | Zheng et al. | |
| 2018/0158434 | A1 | 6/2018 | Bian et al. | |
| 2018/0357979 | A1 | 12/2018 | Nakamura et al. | |
| 2021/0256929 | A1 * | 8/2021 | Wang | G09G 3/3648 |

FOREIGN PATENT DOCUMENTS

| | | | |
|---|---|---|---|
| CN | 107784938 | A | 3/2018 |
| CN | 108417174 | A | 8/2018 |
| WO | 2017110721 | A1 | 6/2017 |

* cited by examiner

DRIVING CHIP, METHOD OF DRIVING DISPLAY PANEL, DRIVING DEVICE, AND DISPLAY DEVICE

CROSS-REFERENCE TO RELATED APPLICATION APPLICATIONS

This application is the U.S. national phase of PCT Application No. PCT/CN2019/070178 filed on Jan. 3, 2019, which claims priority to Chinese Patent Application No. 201810516127.7 filed on May 25, 2018, which are incorporated herein by reference in their entireties.

TECHNICAL FIELD

The present disclosure relates to the field of display technology, in particular to a driving chip, a method of driving a display panel, a driving device, and a display device.

BACKGROUND

Along with the continuous development of the display technology, full-screen display devices and smart wearable display devices have become more and more popular. In these display devices, a boundary of a display region usually includes an arc or irregularly-shaped structure (e.g., a notch). However, for a conventional display product, its pixel is usually of a rectangular shape, so it is impossible for the arrangement of the pixels to perfectly match the boundary with the arch or irregularly-shaped structure. At this time, an image displayed by the display device has obvious sawteeth at a position corresponding to the arc or irregularly-shaped structure of the boundary.

SUMMARY

In one aspect, the present disclosure provides a driving chip applied for a display panel. The display panel includes a plurality of subpixels arranged at a display region, the display region is provided with a boundary extended by a non-straight line, and the plurality of subpixels includes first subpixels separated from the boundary by a distance substantially smaller than a predetermined threshold and second subpixels other than the first subpixels. The driving chip includes: an adjustment circuit configured to, when the display panel is in a predetermined display mode, adjust a first grayscale value of at least a part of the first subpixels in original image data into a second grayscale value substantially smaller than the first grayscale value; and a driving circuit configured to drive the at least a part of first subpixels in accordance with the second grayscale value to display an image.

In a possible embodiment of the present disclosure, the adjustment circuit is further configured to, when the display panel is in the predetermined display mode, adjust the first grayscale value of all the first subpixels into the second grayscale value substantially smaller than the first grayscale value.

In a possible embodiment of the present disclosure, the adjustment circuit is further configured to, when the display panel is in the predetermined display mode, adjust a first grayscale value of a part of the first subpixels into the second grayscale value, the part of the first subpixels include subpixels which are arranged at a region adjacent to the boundary and an average of absolute distances between which and the boundary is substantially smaller than the predetermined threshold, and the second grayscale value is substantially smaller than the first grayscale value of the first subpixels.

In a possible embodiment of the present disclosure, the driving chip further includes a storage unit configured to acquire and store position information about the first subpixels. The adjustment circuit is further configured to, when the display panel is in the predetermined display mode, search and acquire the position information stored in the storage unit, determine the first subpixels in accordance with the position information, and adjust the first grayscale value of the first subpixels in the original image data into the second grayscale value.

In a possible embodiment of the present disclosure, the driving chip further includes a gamma compensation circuit configured to merely compensate for the first grayscale value of the first subpixels in accordance with a gamma value. A gamma corrected value of the first subpixels is stored in the adjustment circuit. The adjustment circuit is further configured to, when the display panel is in the predetermined display mode, search and acquire the stored gamma corrected value of the first subpixels, and correct the gamma value of the gamma compensation circuit in accordance with the gamma corrected value. The gamma compensation circuit is further configured to compensate for the first grayscale value of the first subpixels in the original image data in accordance with the corrected gamma value to acquire the second grayscale value.

In a possible embodiment of the present disclosure, the driving chip further includes: a gamma circuit configured to apply a grayscale voltage to the second subpixels, the grayscale voltage being a grayscale voltage of the second subpixels in the original image data; and a gamma compensation circuit configured to apply a grayscale voltage to the first subpixels, and merely compensate for the grayscale voltage of the first subpixels in accordance with a gamma value. A gamma corrected value of the first subpixels is stored in the adjustment circuit. The adjustment circuit is further configured to, when the display panel is in the predetermined display mode, search and acquire the stored gamma corrected value of the first subpixels, and correct the gamma value of the gamma compensation circuit in accordance with the gamma corrected value. The gamma compensation circuit is further configured to compensate for the first grayscale value of the first subpixels in the original image data in accordance with the corrected gamma value to acquire the second grayscale value.

In a possible embodiment of the present disclosure, the boundary includes an arc-like or irregularly-shaped structure.

In a possible embodiment of the present disclosure, the irregularly-shaped structure is a notch at an edge of the display panel.

In another aspect, the present disclosure provides in some embodiments a method of driving a display panel. The display panel includes a plurality of subpixels arranged at a display region, the display region is provided with a boundary extended by a non-straight line, and the plurality of subpixels includes first subpixels separated from the boundary by a distance substantially smaller than a predetermined threshold and second subpixels other than the first subpixels. The method includes: when the display panel is in a predetermined display mode, adjusting a first grayscale value of at least a part of the first subpixels in original image data into a second grayscale value substantially smaller than the first grayscale value of the first subpixels; and driving the at least a part of the first subpixels in accordance with the second grayscale value to display an image.

In a possible embodiment of the present disclosure, the method further includes, when the display panel is in the predetermined display mode, adjusting the first grayscale value of all the first subpixels into the second grayscale value substantially smaller than the first grayscale value.

In a possible embodiment of the present disclosure, the method further includes, when the display panel is in the predetermined display mode, adjusting a first grayscale value of a part of the first subpixels into the second grayscale value, the part of the first subpixels include subpixels which are arranged at a region adjacent to the boundary and an average of absolute distances between which and the boundary is substantially smaller than the predetermined threshold, and the second grayscale value is substantially smaller than the first grayscale value of the first subpixels.

In a possible embodiment of the present disclosure, the method further includes acquiring and storing position information about the first subpixels. The adjusting the first grayscale value of the first subpixels in the original image data when the display panel is in the predetermined display mode includes, when the display panel is in the predetermined display mode, searching and acquiring the stored position information, determining the first subpixels in accordance with the position information, and adjusting the first grayscale value of the first subpixels in the original image data into the second grayscale value.

In a possible embodiment of the present disclosure, the method further includes storing a gamma corrected value of the first subpixels. The adjusting the first grayscale value of the first subpixels in the original image data when the display panel is in the predetermined display mode includes, when the display panel is in the predetermined display mode, searching and acquiring the stored gamma corrected value of the first subpixels, and correcting a gamma value of a gamma compensation circuit for the first subpixels in accordance with the gamma corrected value, to enable the gamma compensation circuit to compensate for the first grayscale value of the first subpixels in the original image data in accordance with the corrected gamma value to acquire the second grayscale value.

In a possible embodiment of the present disclosure, the method further includes: applying a grayscale voltage to the second subpixels, the grayscale voltage being a grayscale voltage of the second subpixels in the original image data; and applying a grayscale voltage to the first subpixels, and merely compensating for the grayscale voltage of the first subpixels in accordance with a gamma value. The adjusting the first grayscale value of the first subpixels in the original image data when the display panel is in the predetermined display mode includes, when the display panel is in the predetermined display mode, searching and acquiring stored gamma corrected value of the first subpixels, and correcting the gamma value of the gamma compensation circuit in accordance with the gamma corrected value, to enable the gamma compensation circuit to compensate for the first grayscale value of the first subpixels in the original image data in accordance with the corrected gamma value to acquire the second grayscale value.

In a possible embodiment of the present disclosure, the boundary includes an arc-like or irregularly-shaped structure.

In a possible embodiment of the present disclosure, the irregularly-shaped structure is a notch at an edge of the display panel.

In yet another aspect, the present disclosure provides in some embodiments a display device including the above-mentioned driving chip.

In still yet another aspect, the present disclosure provides in some embodiments a driving device, including a processor, a memory, and a computer program stored in the memory and executed by the processor. The processor is configured to execute the computer program to implement the above-mentioned driving method.

In still yet another aspect, the present disclosure provides in some embodiments a computer-readable storage medium storing therein a computer program. The computer program is executed by a processor to implement the above-mentioned driving method.

BRIEF DESCRIPTION OF THE DRAWINGS

In order to illustrate the technical solutions of the present disclosure or the related art in a clearer manner, the drawings desired for the present disclosure or the related art will be described hereinafter briefly. Obviously, the following drawings merely relate to some embodiments of the present disclosure, and based on these drawings, a person skilled in the art may obtain the other drawings without any creative effort.

REFERENCE NUMBER LIST

Figure 1:
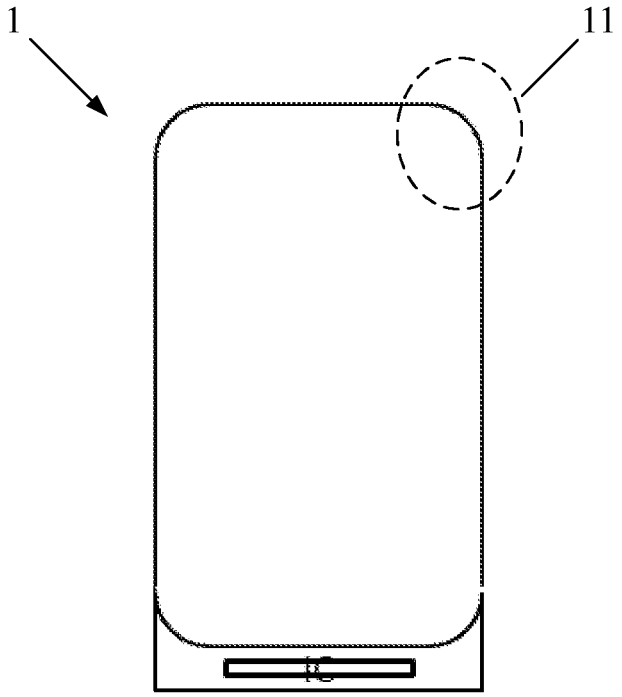
FIG. 1 is a schematic view showing a conventional display device.

1 display device
11 arc
12 irregularly-shaped structure
2 black matrix
3 R subpixel
4 G subpixel
5 B subpixel
6 boundary extended not by a straight line
7 first subpixel
8 second subpixel

DETAILED DESCRIPTION

The present disclosure will be described hereinafter in conjunction with the drawings and embodiments.

Figure 2:
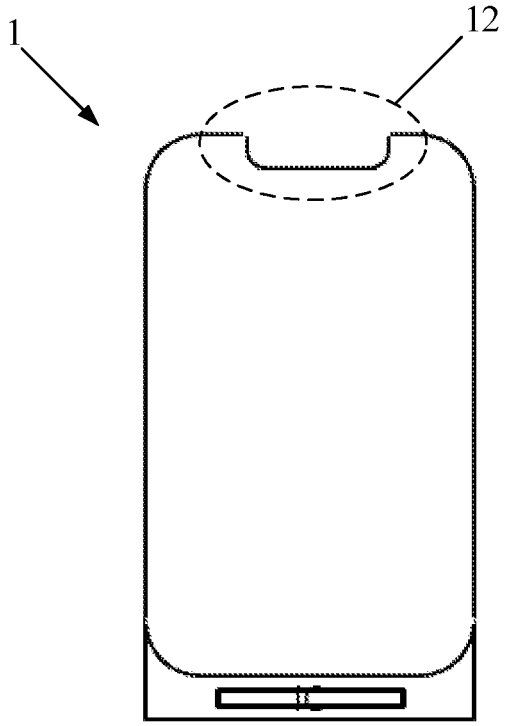
FIG. 2 is another schematic view showing a conventional display device.
Figure 3:
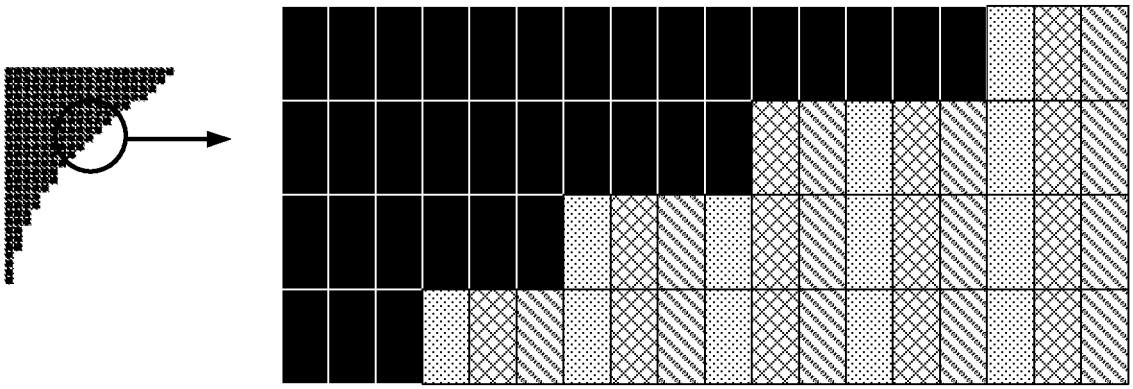
FIG. 3 is a schematic view showing a situation where sawteeth are generated at an edge of an image displayed by the conventional display device.

As shown in FIGS. 1 and 2, for a display device 1 where a boundary of a display region includes an arc 11 or an irregularly-shaped structure 12 (e.g., a notch), the arrangement of pixels cannot perfectly match the boundary with the arc 11 or the irregularly-shaped structure 12, so the pixels are arranged at the boundary irregularly. At this time, as shown in FIG. 3, an image displayed by the display device may have obvious sawteeth at the boundary with the arc or irregularly-shaped structure.

Currently, there mainly exist the following two schemes for preventing the occurrence of the sawteeth.

Figure 4:
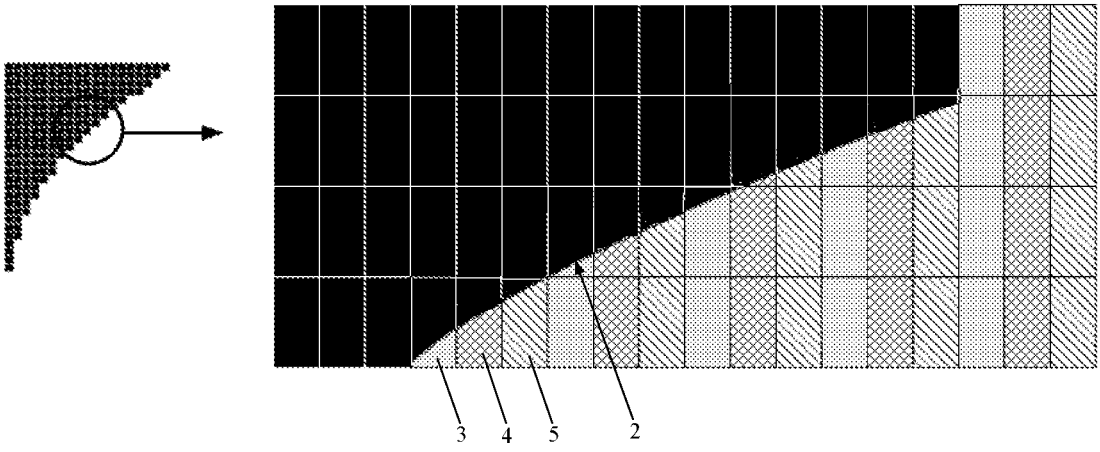
FIG. 4 is a schematic view showing a scheme for preventing the occurrence of the sawteeth for the image displayed by the conventional display device.

In a first scheme, as shown in FIG. 4, at the boundary with the arc or irregularly-shaped structure, the pixels are shielded by black matrices 2, so as to enable the subpixels to display a smooth shape matching the boundary, thereby to prevent the occurrence of the sawteeth to some extent. However, each pixel includes at least three subpixels, i.e., a red (R) subpixel, a green (G) subpixel and a blue (B) subpixel. When the pixel is shielded by the black matrix 2, shielded portions of the subpixels may have different areas, so a colorful border is to be displayed at the boundary with the arc or irregularly-shaped structure. More specifically, for example, for a fourth row in FIG. 4, a shielded portion of an R subpixel 3 may have a largest area, a shielded portion of a B subpixel 5 may have a smallest area, and a shielded portion of a G subpixel 4 may have an area smaller than that of the R subpixel 3 and greater than that of the B subpixel 5. When a white (W) image is displayed by the display device, all the R/G/B subpixels adjacent to the boundary may be enabled, so a display brightness value of the G subpixel 4 and the B subpixel 5 may be far greater than that of the R subpixel 3. At this time, a cyan (C) border, i.e., a colorful border, may be displayed at a corner of the white image.

Figure 5:
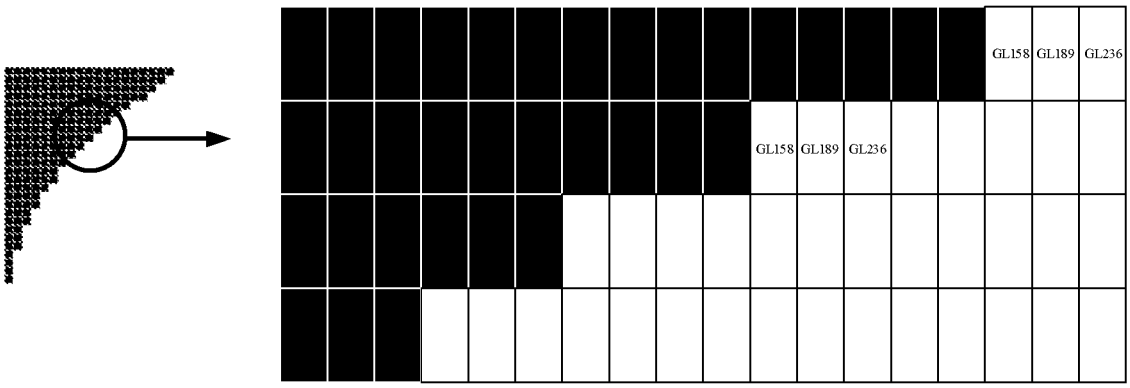
FIG. 5 is a schematic view showing another scheme for preventing the occurrence of the sawteeth for the image displayed by the conventional display device.

In a second scheme, as shown in FIG. 5, the pixel adjacent to the boundary with the arc or irregularly-shaped structure is slightly shielded, i.e., the pixel still functions as an entire pixel and merely its transmittance is decreased (e.g., for the pixels in a first row and a second row in FIG. 5, the transmittances of the pixels adjacent to the boundary are GL236, GL189 and GL158). When a white image is displayed by the display device, the brightness values of the pixels adjacent to the boundary with the arc or irregularly-shaped structure may decrease gradually, so as to prevent the occurrence of obvious sawteeth at the boundary with the arc or irregularly-shaped structure to some extent. However, in actual use, when the pixel is slightly shielded by the black matrix (BM) to control its transmittance, a display effect may depend on a shape of the black matrix and a shielding mode. In order to improve the display effect, it is necessary to determine the appropriate shape of the black matrix and the appropriate shielding mode through a large quantity of experiments, resulting in excessive manufacture cost and time cost.

Based on the above two schemes, in the related art, the occurrence of the obvious sawteeth at the boundary with the arc or irregularly-shaped structure may be prevented mainly by shielding the pixels at the boundary through the black matrices. However, there still exist such disadvantages as the colorful border as well as an increase in the manufacture cost and time cost. It is found that, the transmittance of the pixel at the boundary with the arc or irregularly-shaped structure may be reduced through a driving chip of the display device, so it is able to adjust the transmittance of the pixels without any change in the distribution of the black matrices, thereby to prevent the occurrence of the sawteeth at the boundary with the arc or irregularly-shaped structure to some extent.

Figure 6:
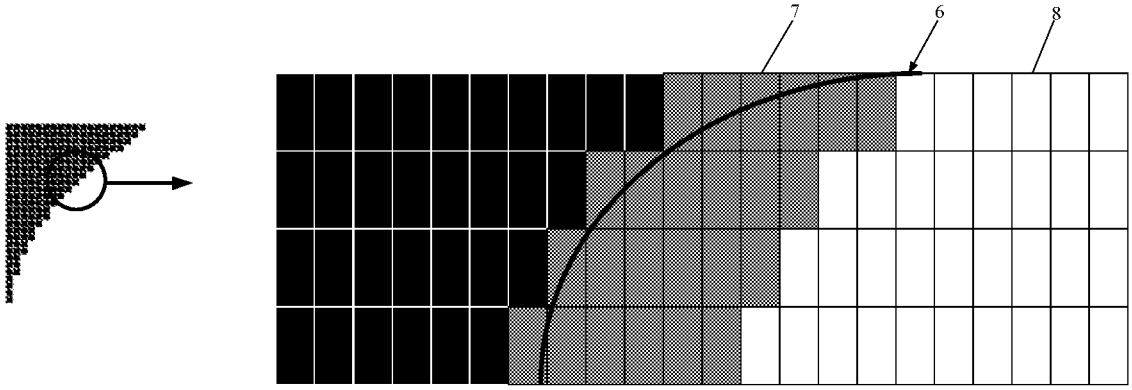
FIG. 6 is a schematic view showing a display panel according to one embodiment of the present disclosure.

The present disclosure provides in some embodiments a driving chip for a display panel. As shown in FIG. 6, the display panel includes a plurality of subpixels arranged at a display region, the display region is provided with a boundary 6 extended not by a straight line, and the plurality of subpixels includes first subpixels 7 separated from the boundary 6 by a distance substantially smaller than a predetermined threshold and second subpixels 8 other than the first subpixels 7. The driving chip 100 includes an adjustment circuit 200 and a driving circuit 300. The adjustment circuit 200 is configured to, when the display panel is in a predetermined display mode, adjust a first grayscale value of at least a part of the first subpixels 7 in original image data into a second grayscale value substantially smaller than the first grayscale value. The driving circuit 300 is configured to drive the at least a part of first subpixels 7 in accordance with the second grayscale value to display an image.

To be specific, the boundary 6 extended not by a straight line of the display region may include a boundary with an arch or an irregularly-shaped boundary not matching a shape of the subpixel. Here, the so-called "not matching" may refer to a situation where the boundary does not coincide with an outer profile of each of the plurality of subpixels adjacent to the boundary.

The predetermined threshold may be defined according to the practical need. The first subpixel 7 may refer to a subpixel separated from the boundary 6 by an absolute distance (i.e., a shortest distance between the first subpixel 7 and the boundary 6) substantially smaller than the predetermined threshold. Also, a region adjacent to the boundary 6 may be determined in accordance with the predetermined threshold, and all the subpixels in this region may be just the first subpixels 7. In addition, a region adjacent to the boundary 6 may be determined in accordance with the predetermined threshold in such a manner that an average of the absolute distances between the subpixels in the region and the boundary 6 is substantially smaller than the predetermined threshold, and the subpixels in this region may be just the first subpixels 7. Of course, the predetermined threshold may also be defined in any other ways, but not limited to those mentioned above, according to the practical need.

The original image data may be just data corresponding to an original image inputted by a central processing unit (CPU) of the display panel when the display panel is in the predetermined display mode. When the image is displayed by the display panel in accordance with the original image data, an actual display effect may be achieved at the display region, while a black image may be displayed at a non-display region (i.e., a region beyond the boundary extended by a non-straight line), resulting in the sawteeth at the boundary extended by a non-straight line.

When the display panel is driven by the driving chip to display the image, a driving procedure will be described as follows.

In the predetermined display mode, the first grayscale value of at least a part of first subpixels in the original image data may be adjusted by adjustment circuit of the driving chip into the second grayscale value substantially smaller than the first grayscale value, and then the first subpixels may be driven by the driving circuit of the driving chip in accordance with the second grayscale value so as to display the image in such a manner that a display brightness value of each first subpixel is smaller than a corresponding display brightness value in the original image data. In addition, the second subpixels may also be driven by the driving chip in accordance with the grayscale value of the second subpixels in the original image data to display the image, so as to enable the display panel to be in a display state.

On the basis of the structure and the driving procedure of the driving chip, the adjustment circuit may adjust the first grayscale value of at least a part of first subpixels in the original image data into the second grayscale value substantially smaller than the first grayscale value, and the driving circuit may drive the first subpixels in accordance with the second grayscale value to display the image in such a manner that an actual display brightness value of each first subpixel is smaller than the corresponding brightness value of the first subpixel in the original image data. Hence, when the display panel is driven by the driving chip to display the image, it is able to provide the first subpixels adjacent to the boundary extended by a non-straight line with a relatively low display brightness value, prevent a user from sensing a brightness change at a periphery of the image, and prevent the occurrence of the sawteeth at the boundary to some extent, thereby to improve the display quality.

In the embodiments of the present disclosure, it is unnecessary to control the display brightness value of the first subpixel by shielding the first subpixel through a black matrix, and instead, the display brightness value of the first subpixel may be controlled through the driving chip. When the display panel is driven by the driving chip to display the image, it is able to adjust a transmittance of the first subpixel without changing the distribution of the black matrices in the display panel, and determine a corresponding display effect in response to different transmittances of the first subpixel. Hence, when the display panel is driven by the driving chip to display the image, it is able to not only prevent the occurrence of the sawteeth at the boundary extended by a non-straight line, but also prevent the occurrence of a colorful border as well as an increase in the manufacture cost and time cost.

The adjustment circuit is further configured to, when the display panel is in the predetermined display mode, adjust the first grayscale value of all the first subpixels into the second grayscale value substantially smaller than the first grayscale value.

To be specific, when the first grayscale value of all the first subpixels is adjusted by the adjustment circuit into the second grayscale value substantially smaller than the first grayscale value of the first subpixel, all the first subpixels adjacent to the boundary extended by a non-straight line in the display panel may have a relatively low display brightness value. At this time, it is able to further prevent the occurrence of the sawteeth at the nonlinearly-extending boundary when the display panel is in the predetermined display mode, thereby to improve the display quality as well as the user experience.

The driving chip may further include a storage unit 400 configured to acquire and store position information about the first subpixels. The adjustment circuit 200 is further configured to, when the display panel is in the predetermined display mode, search and acquire the position information stored in the storage unit, determine the first subpixels in accordance with the position information, and adjust the first grayscale value of the first subpixels in the original image data into the second grayscale value.

To be specific, the subpixels of the display panel may be arranged in an array form. A part of the subpixels for display (i.e., the subpixels at the display region) have already been determined during the design of the display panel. The subpixels for display and the position information about the subpixels may be recorded once in the storage unit of the driving chip through codes. When the display panel is in the predetermined display mode, a display function may be achieved in accordance with the information stored in the storage unit, without any necessity to calculating positions of the subpixels for display, so it is able to reduce the calculation burden. More specifically, the storage unit of the driving chip may acquire and store the position information about the first subpixels (i.e., the subpixels whose grayscale voltage is to be adjusted) and the position information about the second subpixels (i.e., the subpixels whose grayscale voltage is not be adjusted and which are driven to display the image in accordance with the original image data). It should be appreciated that, the storage unit may be, but not limited to, a clock memory.

When the display panel is in the predetermined display mode, the adjustment circuit may search and acquire the position information in the storage unit, determine the first subpixels in all the subpixels of the display panel in accordance with the position information, and adjust the first grayscale value of the determined first subpixels in the original image data into the second grayscale value, so as to enable the actual display brightness value of each first subpixel to be smaller than the corresponding display brightness value in the original image data, thereby to prevent the occurrence of the sawteeth in the image at the boundary.

In the embodiments of the present disclosure, the driving chip 100 may further include a gamma compensation circuit 500 configured to merely compensate for the first grayscale value of the first subpixels in accordance with a gamma value. A gamma corrected value of the first subpixels may be stored in the adjustment circuit 200. The adjustment circuit 200 is further configured to, when the display panel is in the predetermined display mode, search and acquire the stored gamma corrected value of the first subpixels, and correct the gamma value of the gamma compensation circuit in accordance with the gamma corrected value. The gamma compensation circuit 500 is further configured to compensate for the first grayscale value of the first subpixels in the original image data in accordance with the corrected gamma value to acquire the second grayscale value.

To be specific, the driving chip 100 may further include a gamma circuit 600 and a gamma compensation circuit 500. The gamma circuit 600 is configured to apply a grayscale voltage to the second subpixels, and the grayscale voltage is a grayscale voltage of the second subpixels in the original image data. It should be appreciated that, each second subpixel may merely correspond to one gamma circuit 600, and the grayscale voltage may be applied to the second subpixel by the corresponding gamma circuit 600. In this way, it is unnecessary to provide the driving chip with an additional gamma compensation circuit corresponding to the second subpixel, thereby to save a space of the driving chip.

The gamma compensation circuit 500 and the gamma circuit 600 may not be the same. The gamma compensation circuit 500 is configured to control the first subpixel, and compensate for the grayscale voltage for the first subpixel in accordance with the gamma value. More specifically, a gamma corrected value of the first subpixels may be stored in the adjustment circuit 200. The adjustment circuit 200 is further configured to, when the display panel is in the predetermined display mode, search and acquire the stored gamma corrected value of the first subpixels, and correct the gamma value of the gamma compensation circuit in accordance with the gamma corrected value. The gamma compensation circuit 500 is further configured to compensate for the first grayscale value of the first subpixels in the original image data in accordance with the corrected gamma value to acquire the second grayscale value.

Figure 7:
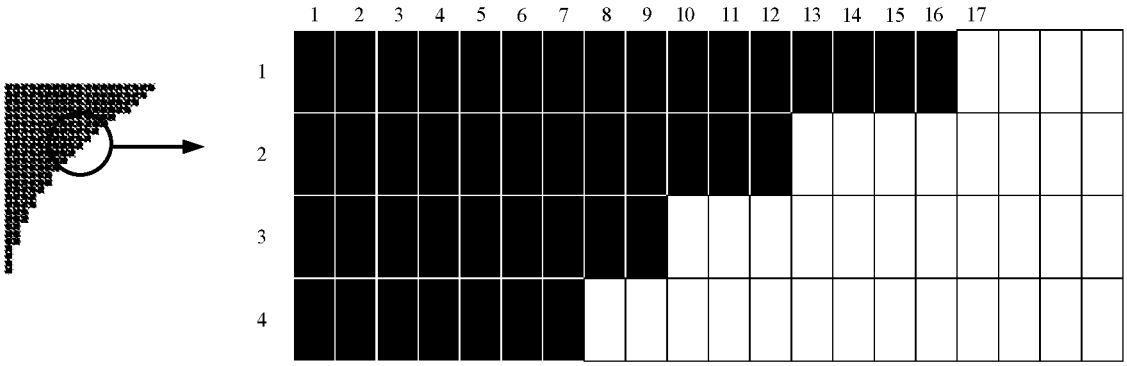
FIG. 7 is another schematic view showing the display panel according to one embodiment of the present disclosure.

More specifically, taking the pixels in a first row in FIG. 7 as an example, the pixels starting from a $17^{th}$ column may be adopted for valid display. When the pixel in the first row and the $17^{th}$ column is enabled and a grayscale voltage applied to the pixel in the original image data (e.g., an original image is a pure white image) is 4.5V, in the predetermined display mode, grayscale voltages applied to subpixels of the pixel in the first row and the $17^{th}$ column may be controlled by the gamma compensation circuit to be substantially smaller than 4.5V through codes in accordance with the corrected gamma value. In this way, it is able to prevent the occurrence of the sawteeth in the display image at the boundary extended by a non-straight line.

It should be appreciated that, the gamma corrected value of the first subpixel stored in the adjustment circuit 200 may be acquired in advance through experiments. To be specific, the first subpixels of the display panel may be adjusted to have a certain transmittance, and the display effects of the display panel may be determined when all the first subpixels of the display panel have different transmittances. Then, the gamma corrected value of the first subpixels may be determined when the first subpixels have a certain transmittance, and the subsequent mass production of the display panels may be performed in accordance with the gamma corrected value.

An operating procedure of the driving chip will be described hereinafter in mode tails.

Figure 8:
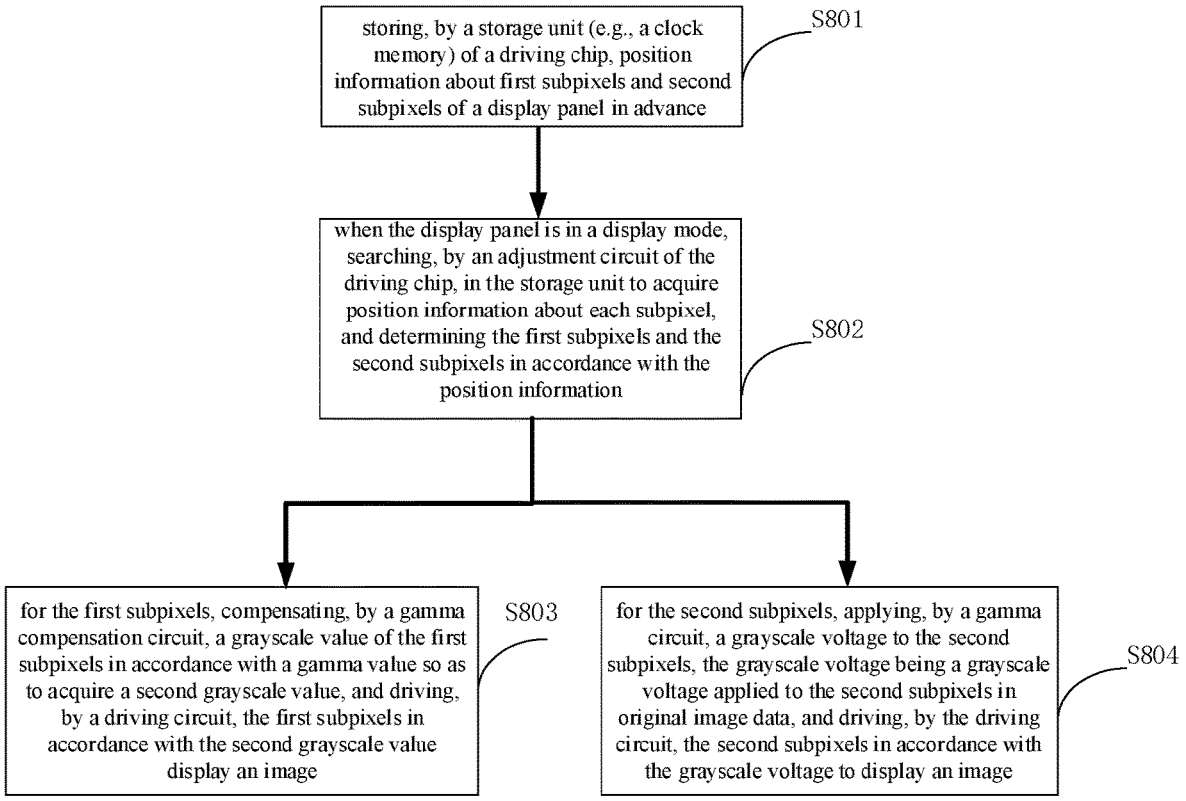
FIG. 8 is a flow chart of a driving method according to one embodiment of the present disclosure.
Figure 9:
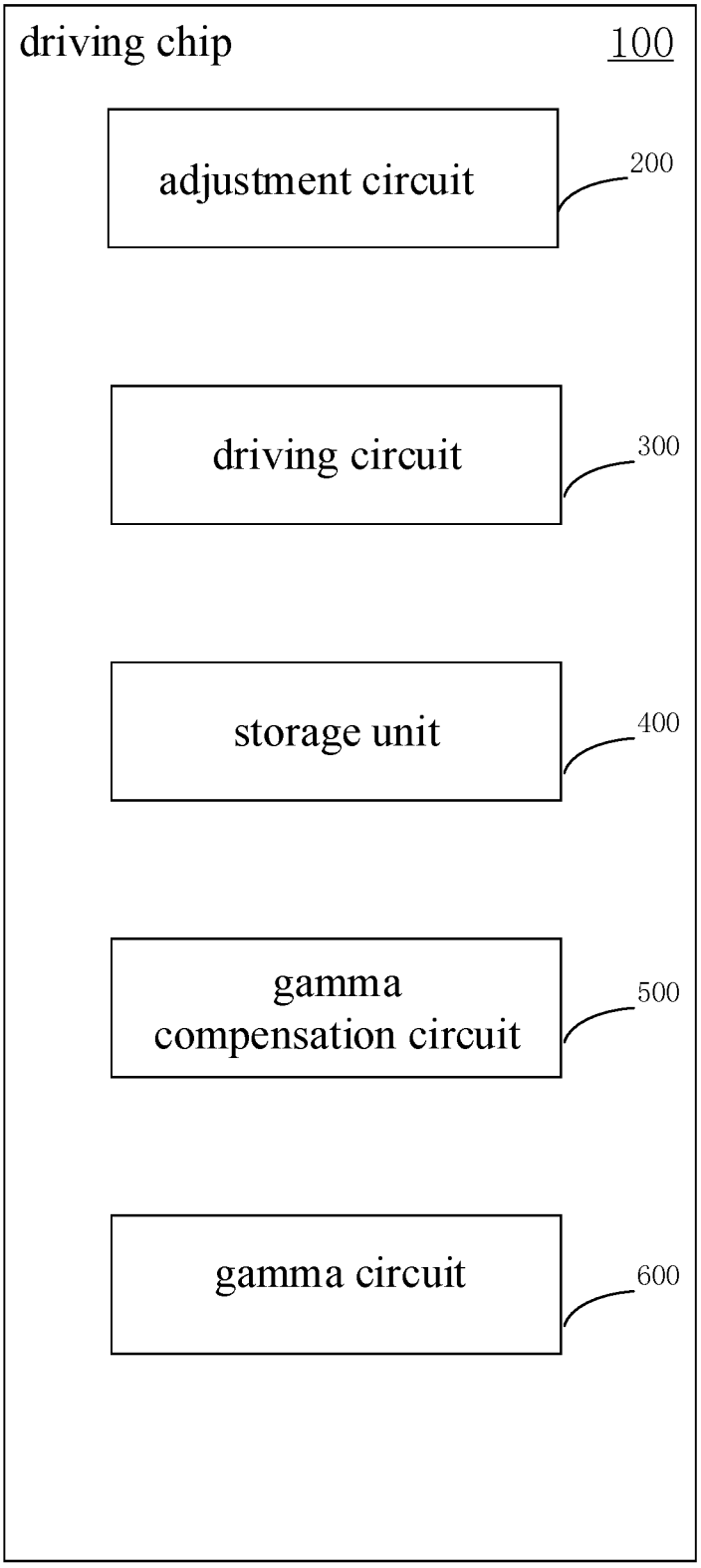
FIG. 9 is a block diagram of a driving chip according to one embodiment of the present disclosure.

As shown in FIG. 8, the position information about the first subpixels and the second subpixels of the display panel may be stored in advance in the storage unit (e.g., the clock memory) of the driving chip (Step S801). When the display panel is driven by the driving chip to display an image, the adjustment circuit of the driving chip may search in the storage unit to acquire the position information about each subpixel of the display panel, and determine the first subpixels and the second subpixels in accordance with the position information (Step S802). For the first subpixels, the gamma compensation circuit may compensate for the first grayscale value of the first subpixels in the original image data in accordance with the gamma value to acquire the second grayscale voltage, and the driving circuit of the driving chip may drive the first subpixels in accordance with the second grayscale value to display the image (Step S803). For the second subpixels, the gamma circuit may apply the grayscale voltage to the second subpixels (the grayscale voltage is a grayscale voltage applied to the second subpixels in the original image data), and the driving circuit of the driving chip may drive the second subpixels in accordance with the grayscale voltage to display the image (Step S804).

The present disclosure further provides in some embodiments a method for driving a display panel including the above-mentioned driving chip. The display panel includes a plurality of subpixels arranged at a display region, the display region is provided with a boundary extended by a non-straight line, and the plurality of subpixels includes first subpixels separated from the boundary by a distance substantially smaller than a predetermined threshold and second subpixels other than the first subpixels. The method includes: when the display panel is in a predetermined display mode, adjusting a first grayscale value of at least a part of the first subpixels in original image data into a second grayscale value substantially smaller than the first grayscale value of the first subpixels; and driving the at least a part of the first subpixels in accordance with the second grayscale value to display an image.

To be specific, when the display panel is driven to display the image through the above-mentioned method, a driving procedure will be described as follows.

In the predetermined display mode, the first grayscale value of at least a part of first subpixels in the original image data may be adjusted by adjustment circuit of the driving chip into the second grayscale value substantially smaller than the first grayscale value, and then the first subpixels may be driven by the driving circuit of the driving chip in accordance with the second grayscale value so as to display the image in such a manner that a display brightness value of each first subpixel is smaller than a corresponding display brightness value in the original image data. In addition, the second subpixels may also be driven by the driving chip in accordance with the grayscale value of the second subpixels in the original image data to display the image, so as to enable the display panel to be in a display state.

When the display panel is driven to display the image through the above-mentioned method, the adjustment circuit may adjust the first grayscale value of at least a part of first subpixels in the original image data into the second grayscale value substantially smaller than the first grayscale value, and the driving circuit may drive the first subpixels in accordance with the second grayscale value to display the image in such a manner that an actual display brightness value of each first subpixel is smaller than the corresponding brightness value of the first subpixel in the original image data. Hence, when the display panel is driven to display the image through the above-mentioned method, it is able to provide the first subpixels adjacent to the boundary extended by a non-straight line with a relatively low display brightness value, prevent a user from sensing a brightness change at a periphery of the image, and prevent the occurrence of the sawteeth at the boundary to some extent, thereby to improve the display quality.

In addition, in the embodiments of the present disclosure, it is unnecessary to control the display brightness value of the first subpixel by shielding the first subpixel through a black matrix, and instead, the display brightness value of the first subpixel may be controlled through the driving chip. When the display panel is driven to display the image through the above-mentioned method, it is able to adjust a transmittance of the first subpixel without changing the distribution of the black matrices in the display panel, and determine a corresponding display effect in response to different transmittances of the first subpixel. Hence, when the display panel is driven by the driving chip to display the image, it is able to not only prevent the occurrence of the sawteeth at the boundary extended by a non-straight line, but also prevent the occurrence of a colorful border as well as an increase in the manufacture cost and time cost.

The method may further include, when the display panel is in the predetermined display mode, adjusting the first grayscale value of all the first subpixels into the second grayscale value substantially smaller than the first grayscale value.

To be specific, when the first grayscale value of all the first subpixels is adjusted by the adjustment circuit into the second grayscale value substantially smaller than the first grayscale value of the first subpixel in the predetermined display mode, all the first subpixels adjacent to the nonlinearly-extending boundary in the display panel may have a relatively low display brightness value. At this time, it is able to further prevent the occurrence of the sawteeth at the nonlinearly-extending boundary when the display panel is in the predetermined display mode, thereby to improve the display quality as well as the user experience.

The method may further include acquiring and storing position information about the first subpixels. The adjusting the first grayscale value of the first subpixels in the original image data when the display panel is in the predetermined display mode may include, when the display panel is in the predetermined display mode, searching and acquiring the stored position information, determining the first subpixels in accordance with the position information, and adjusting the first grayscale voltage of the first subpixels in the original image data into the second grayscale voltage.

To be specific, the subpixels of the display panel may be arranged in an array form. A part of the subpixels for display (i.e., the subpixels at the display region) have already been determined during the design of the display panel. The subpixels for display and the position information about the subpixels may be recorded once in the storage unit of the driving chip through codes. When the display panel is in the predetermined display mode, a display function may be achieved in accordance with the information stored in the storage unit, without any necessity to calculating positions of the subpixels for display, so it is able to reduce the calculation burden. More specifically, the storage unit of the driving chip may acquire and store the position information about the first subpixels (i.e., the subpixels whose grayscale voltage is to be adjusted) and the position information about the second subpixels (i.e., the subpixels whose grayscale voltage is not to be adjusted and which are driven to display the image in accordance with the original image data).

When the display panel is in the predetermined display mode, the adjustment circuit may search and acquire the position information in the storage unit, determine the first subpixels in all the subpixels of the display panel in accordance with the position information, and adjust the first grayscale value of the determined first subpixels in the original image data into the second grayscale value, so as to enable the actual display brightness value of each first subpixel to be smaller than the corresponding display brightness value in the original image data, thereby to prevent the occurrence of the sawteeth in the image at the boundary.

The method may further include storing a gamma corrected value of the first subpixels. The adjusting the first grayscale value of the first subpixels in the original image data when the display panel is in the predetermined display mode may include, when the display panel is in the predetermined display mode, searching and acquiring the stored gamma corrected value of the first subpixels, and correcting a gamma value of a gamma compensation circuit for the first subpixels in accordance with the gamma corrected value, to enable the gamma compensation circuit to compensate for the first grayscale value of the first subpixels in the original image data in accordance with the corrected gamma value to acquire the second grayscale value.

To be specific, the driving chip may further include a gamma circuit and a gamma compensation circuit. The gamma circuit is configured to apply a grayscale voltage to the second subpixels, and the grayscale voltage is a grayscale voltage of the second subpixels in the original image data. The gamma compensation circuit and the gamma circuit may not be the same. The gamma compensation circuit is configured to control the first subpixel, and compensate for the grayscale voltage for the first subpixel in accordance with the gamma value. More specifically, a gamma corrected value of the first subpixels may be stored in the adjustment circuit, and the gamma corrected value may be acquired in advance through experiments. The adjustment circuit is further configured to, when the display panel is in the predetermined display mode, search and acquire the stored gamma corrected value of the first subpixels, and correct the gamma value of the gamma compensation circuit in accordance with the gamma corrected value. The gamma compensation circuit is further configured to compensate for the first grayscale value of the first subpixels in the original image data in accordance with the corrected gamma value to acquire the second grayscale value.

The present disclosure further provides in some embodiments a display device including the above-mentioned driving chip.

In the embodiments of the present disclosure, when the display device is driven by the driving chip to display an image, the driving chip may control the first subpixels adjacent to the boundary extended by a non-straight line to have a relatively low display brightness value, so as to prevent a user from sensing a brightness change at a periphery of the display image. Hence, when the display device includes the above-mentioned driving chip, it is able to prevent the occurrence of the sawteeth at the boundary, thereby to improve the display quality as well as the user experience.

In addition, the display brightness value of each first subpixel may be controlled through the driving chip, so when the display device includes the above-mentioned driving chip, it is able to adjust the transmittance of the first subpixel without any necessity to change the distribution of the black matrices of the display device, and determine the display effects of the display device in response to different transmittances of the first subpixel, thereby to prevent the occurrence of sawteeth at the boundary extended by a non-straight line to some extent.

The present disclosure further provides in some embodiments a driving device, including a processor, a memory, and a computer program stored in the memory and executed by the processor. The processor is configured to execute the computer program, so as to implement the above-mentioned method. To be specific, the processor is coupled to the memory, and configured to call the computer program stored in the memory, so as to implement the above-mentioned method.

More specifically, when the display panel is in a predetermined display mode, the processor is configured to adjust a first grayscale value of at least a part of first subpixels in original image data into a second grayscale value substantially smaller than the first grayscale value. The processor is further configured to drive the first subpixels in accordance with the second grayscale value to display an image.

The processor is further configured to, when the display panel is in the predetermined display mode, adjust the first grayscale value of all the first subpixels in the original image data into the second grayscale value.

The processor is further configured to: acquire and store position information about the first subpixels; and when the display panel is in the predetermined display mode, search and acquire the stored position information, determine the first subpixels in accordance with the position information, and adjust the first grayscale value of the first subpixels in the original image data into the second grayscale value.

The processor is further configured to: store a gamma corrected value of the first subpixels; and when the display panel is in the predetermined display mode, search and acquire the stored gamma corrected value of the first subpixels, correct the gamma value of the gamma compensation circuit in accordance with the gamma corrected value, and compensate for the first grayscale value of the first subpixels in the original image data in accordance with the corrected gamma value to acquire the second grayscale value.

In the embodiments of the present disclosure, when the display panel is driven by the driving chip to display the image, it is able to provide the first subpixels adjacent to the boundary extended by a non-straight line with a relatively low display brightness value, prevent a user from sensing a brightness change at a periphery of the image, and prevent the occurrence of the sawteeth at the boundary to some extent, thereby to improve the display quality. In addition, when the display panel is driven by the driving chip to display the image, it is able to adjust a transmittance of the first subpixel without changing the distribution of the black matrices in the display panel, and determine a corresponding display effect in response to different transmittances of the first subpixel. Hence, when the display panel is driven by the driving chip to display the image, it is able to not only prevent the occurrence of the sawteeth at the boundary extended by a non-straight line, but also prevent the occurrence of a colorful border as well as an increase in the manufacture cost and time cost.

It should be appreciated that, the processor may include one processor, or a plurality of processing elements. For example, the processor may be a CPU, or one or more integrated circuits configured to implement the above-mentioned method.

The memory may include a volatile memory, a nonvolatile memory or both. The nonvolatile memory may include a Read-Only Memory (ROM), a Programmable ROM (PROM), an Erasable PROM (EPROM), an electrically EPROM (EEPROM) or a flash memory. The volatile memory may include a Random Access Memory (RAM) which serves as an external high-speed cache. Illustratively but nonrestrictively, the RAM includes Static RAM (SRAM), Dynamic RAM (DRAM), Synchronous DRAM (SDRAM), Double Data Rate SDRAM (DDRSDRAM), Enhanced SDRAM (ESDRAM), Synchronous Link DRAM (SLDRAM) or Direct Rambus RAM (DRRAM). The memory intends to include, but not limited to, the above-mentioned and any other appropriate memories.

The present disclosure further provides in some embodiments a computer-readable storage medium storing therein a computer program. The computer program is executed by a processor so as to implement the above-mentioned method.

The computer program capable of implementing the above-mentioned method may be stored in the computer-readable storage medium, and the types of the computer-readable storage medium may refer to those of the memory mentioned hereinabove. In addition, the programs stored in the computer-readable storage medium and the steps executed by the processor may refer to those mentioned hereinabove.

It should be appreciated that, the embodiments of the present disclosure may be implemented by hardware, software, firmware, middleware, microcode or a combination thereof. For the hardware implementation, the processor may include one or more of an ASIC, a DSP, a DSP device (DSPD), a Programmable Logic Device (PLD), an FPGA, a general-purpose processor, a controller, a microcontroller, a microprocessor, any other electronic unit capable of achieving the functions in the present disclosure, or a combination thereof.

For the software implementation, the scheme in the embodiments of the present disclosure may be implemented through modules capable of achieving the functions in the present disclosure (e.g., processes or functions). Software codes may be stored in the memory and executed by the processor. The memory may be implemented inside or outside the processor.

The above embodiments have been described in a progressive manner, and the same or similar contents in the embodiments will not be repeated, i.e., each embodiment merely focuses on the difference from the others.

It should be appreciated that, the present disclosure may be provided as a method, a system or a computer program product, so the present disclosure may be in the form of full hardware embodiments, full software embodiments, or combinations thereof. In addition, the present disclosure may be in the form of a computer program product implemented on one or more computer-readable storage mediums (including but not limited to disk memory, Compact Disc-Read Only Memory (CD-ROM) and optical memory) including computer-readable program codes.

The present disclosure has been described with reference to the flow charts and/or block diagrams of the method, device (system) and computer program product according to the embodiments of the present disclosure. It should be understood that computer program instructions may be used to implement each of the work flows and/or blocks in the flow charts and/or the block diagrams, and the combination of the work flows and/or blocks in the flow charts and/or the block diagrams. These computer program instructions may be provided to a processor of a common computer, a dedicate computer, an embedded processor or any other programmable data processing devices to create a machine, so that instructions executable by the processor of the computer or the other programmable data processing devices may create a device to achieve the functions assigned in one or more work flows in the flow chart and/or one or more blocks in the block diagram.

These computer program instructions may also be stored in a computer readable storage medium that may guide the computer or the other programmable data process devices to function in a certain way, so that the instructions stored in the computer readable storage medium may create a product including an instruction unit which achieves the functions assigned in one or more flows in the flow chart and/or one or more blocks in the block diagram.

These computer program instructions may also be loaded in the computer or the other programmable data process devices, so that a series of operation steps are executed on the computer or the other programmable devices to create processes achieved by the computer. Therefore, the instructions executed in the computer or the other programmable devices provide the steps for achieving the function assigned in one or more flows in the flow chart and/or one or more blocks in the block diagram.

Although the preferred embodiments are described above, a person skilled in the art may make modifications and alterations to these embodiments in accordance with the basic concept of the present disclosure. So, the attached claims are intended to include the preferred embodiments and all of the modifications and alterations that fall within the scope of the present disclosure.

It should be further appreciated that, such words as "first" and "second" are merely used to separate one entity or operation from another entity or operation, but are not necessarily used to represent or imply any relation or order between the entities or operations. In addition, such terms as "include" or "including" or any other variations involved in the present disclosure intend to provide non-exclusive coverage, so that a procedure, method, article or device including a series of elements may also include any other elements not listed herein, or may include any inherent elements of the procedure, method, article or device. If without any further limitations, for the elements defined by such sentence as "including one . . . ", it is not excluded that the procedure, method, article or device including the elements may also include any other identical elements.

It should be further appreciated that, units and steps described in the embodiments of the present disclosure may be implemented in the form of electronic hardware, or a combination of a computer program and the electronic hardware. Whether or not these functions are executed by hardware or software depends on specific applications or design constraints of the technical solution. Different methods may be adopted with respect to the specific applications so as to achieve the described functions, without departing from the scope of the present disclosure.

The above embodiments are for illustrative purposes only, but the present disclosure is not limited thereto. Obviously, a person skilled in the art may make further modifications and improvements without departing from the spirit of the present disclosure, and these modifications and improvements shall also fall within the scope of the present disclosure.

What is claimed is:

1. A driving chip, applied for a display panel, wherein the display panel comprises a plurality of subpixels arranged at a display region, the display region is provided with a boundary extended by a non-straight line, and the plurality of subpixels comprises first subpixels separated from the boundary by a distance substantially smaller than a predetermined threshold and second subpixels other than the first subpixels, wherein the driving chip comprises:

an adjustment circuit configured to, when the display panel is in a predetermined display mode, adjust a first grayscale value of at least a part of the first subpixels in original image data into a second grayscale value substantially smaller than the first grayscale value; and a driving circuit configured to drive the at least a part of first subpixels in accordance with the second grayscale value to display an image, wherein the adjustment circuit is further configured to, when the display panel is in the predetermined display mode, adjust a first grayscale value of a part of the first subpixels into the second grayscale value, the part of the first subpixels comprise subpixels which are arranged at a region adjacent to the boundary and an average of absolute distances between which and the boundary is substantially smaller than the predetermined threshold, and the second grayscale value is substantially smaller than the first grayscale value of the first subpixels.

2. The driving chip according to claim 1, wherein the adjustment circuit is further configured to, when the display panel is in the predetermined display mode, adjust the first grayscale value of all the first subpixels into the second grayscale value substantially smaller than the first grayscale value.

3. The driving chip according to claim 1, further comprising a storage unit configured to acquire and store position information about the first subpixels, wherein the adjustment circuit is further configured to, when the display panel is in the predetermined display mode, search and acquire the position information stored in the storage unit, determine the first subpixels in accordance with the position information, and adjust the first grayscale value of the first subpixels in the original image data into the second grayscale value.

4. The driving chip according to claim 3, further comprising:

a gamma compensation circuit configured to merely compensate for the first grayscale value of the first subpixels in accordance with a gamma value, wherein a gamma corrected value of the first subpixels is stored in the adjustment circuit;

the adjustment circuit is further configured to, when the display panel is in the predetermined display mode, search and acquire the stored gamma corrected value of the first subpixels, and correct the gamma value of the gamma compensation circuit in accordance with the gamma corrected value; and the gamma compensation circuit is further configured to compensate for the first grayscale value of the first subpixels in the original image data in accordance with the corrected gamma value to acquire the second grayscale value.

5. The driving chip according to claim 3, further comprising:

a gamma circuit configured to apply a grayscale voltage to the second subpixels, the grayscale voltage being a grayscale voltage of the second subpixels in the original image data; and a gamma compensation circuit configured to apply a grayscale voltage to the first subpixels, and merely compensate for the grayscale voltage of the first subpixels in accordance with a gamma value, wherein a gamma corrected value of the first subpixels is stored in the adjustment circuit;

the adjustment circuit is further configured to, when the display panel is in the predetermined display mode, search and acquire the stored gamma corrected value of the first subpixels, and correct the gamma value of the gamma compensation circuit in accordance with the gamma corrected value; and the gamma compensation circuit is further configured to compensate for the first grayscale value of the first subpixels in the original image data in accordance with the corrected gamma value to acquire the second grayscale value.

6. The driving chip according to claim 1, wherein the boundary comprises an arc-like or irregularly-shaped structure.

7. The driving chip according to claim 6, wherein the irregularly-shaped structure is a notch at an edge of the display panel.

8. A display device, comprising the driving chip according to claim 1.

9. A method of driving a display panel, wherein the display panel comprises a plurality of subpixels arranged at a display region, the display region is provided with a boundary extended by a non-straight line, and the plurality of subpixels comprises first subpixels separated from the boundary by a distance substantially smaller than a predetermined threshold and second subpixels other than the first subpixels, wherein the method comprises:

when the display panel is in a predetermined display mode, adjusting a first grayscale value of at least a part of the first subpixels in original image data into a second grayscale value substantially smaller than the first grayscale value of the first subpixels;

driving the at least a part of the first subpixels in accordance with the second grayscale value to display an image; and when the display panel is in the predetermined display mode, adjusting a first grayscale value of a part of the first subpixels into the second grayscale value, wherein the part of the first subpixels comprise subpixels which are arranged at a region adjacent to the boundary and an average of absolute distances between which and the boundary is substantially smaller than the predetermined threshold, and the second grayscale value is substantially smaller than the first grayscale value of the first subpixels.

10. The method according to claim 9, further comprising, when the display panel is in the predetermined display mode, adjusting the first grayscale value of all the first subpixels into the second grayscale value substantially smaller than the first grayscale value.

11. The method according to claim 9, further comprising acquiring and storing position information about the first subpixels, wherein the adjusting the first grayscale value of the first subpixels in the original image data when the display panel is in the predetermined display mode comprises:

when the display panel is in the predetermined display mode, searching and acquiring the stored position information, determining the first subpixels in accordance with the position information, and adjusting the first grayscale value of the first subpixels in the original image data into the second grayscale value.

12. The method according to claim 11, further comprising storing a gamma corrected value of the first subpixels, wherein the adjusting the first grayscale value of the first subpixels in the original image data when the display panel is in the predetermined display mode comprises:

when the display panel is in the predetermined display mode, searching and acquiring the stored gamma corrected value of the first subpixels, and correcting a gamma value of a gamma compensation circuit for the first subpixels in accordance with the gamma corrected value, to enable the gamma compensation circuit to compensate for the first grayscale value of the first subpixels in the original image data in accordance with the corrected gamma value to acquire the second grayscale value.

13. The method according to claim 11, further comprising:

applying a grayscale voltage to the second subpixels, the grayscale voltage being a grayscale voltage of the second subpixels in the original image data; and applying a grayscale voltage to the first subpixels, and merely compensating for the grayscale voltage of the first subpixels in accordance with a gamma value, wherein the adjusting the first grayscale value of the first subpixels in the original image data when the display panel is in the predetermined display mode comprises:

when the display panel is in the predetermined display mode, searching and acquiring stored gamma corrected value of the first subpixels, and correcting the gamma value of the gamma compensation circuit in accordance with the gamma corrected value, to enable the gamma compensation circuit to compensate for the first grayscale value of the first subpixels in the original image data in accordance with the corrected gamma value to acquire the second grayscale value.

14. The method according to claim 9, wherein the boundary comprises an arc-like or irregularly-shaped structure.

15. The method according to claim 14, wherein the irregularly-shaped structure is a notch at an edge of the display panel.

16. A driving device, comprising a processor, a memory, and a computer program stored in the memory and executed by the processor, wherein the processor is configured to execute the computer program to implement the method according to claim 9.

17. A non-transitory computer-readable storage medium storing therein a computer program, wherein the computer program is executed by a processor to implement the method according to claim 9.

18. A driving chip, applied for a display panel, wherein the display panel comprises a plurality of subpixels arranged at a display region, the display region is provided with a boundary extended by a non-straight line, and the plurality of subpixels comprises first subpixels separated from the boundary by a distance substantially smaller than a predetermined threshold and second subpixels other than the first subpixels, wherein the driving chip comprises:

an adjustment circuit configured to, when the display panel is in a predetermined display mode, adjust a first grayscale value of at least a part of the first subpixels in original image data into a second grayscale value substantially smaller than the first grayscale value; and a driving circuit configured to drive the at least a part of first subpixels in accordance with the second grayscale value to display an image, wherein the driving chip further includes a storage unit configured to acquire and store position information about the first subpixels, wherein the adjustment circuit is further configured to, when the display panel is in the predetermined display mode, search and acquire the position information stored in the storage unit, determine the first subpixels in accordance with the position information, and adjust the first grayscale value of the first subpixels in the original image data into the second grayscale value.

19. The driving chip according to claim 18, further comprising:

a gamma compensation circuit configured to merely compensate for the first grayscale value of the first subpixels in accordance with a gamma value, wherein a gamma corrected value of the first subpixels is stored in the adjustment circuit;

the adjustment circuit is further configured to, when the display panel is in the predetermined display mode, search and acquire the stored gamma corrected value of the first subpixels, and correct the gamma value of the gamma compensation circuit in accordance with the gamma corrected value; and the gamma compensation circuit is further configured to compensate for the first grayscale value of the first subpixels in the original image data in accordance with the corrected gamma value to acquire the second grayscale value.

20. The driving chip according to claim 18, further comprising:

a gamma circuit configured to apply a grayscale voltage to the second subpixels, the grayscale voltage being a grayscale voltage of the second subpixels in the original image data; and a gamma compensation circuit configured to apply a grayscale voltage to the first subpixels, and merely compensate for the grayscale voltage of the first subpixels in accordance with a gamma value, wherein a gamma corrected value of the first subpixels is stored in the adjustment circuit;

the adjustment circuit is further configured to, when the display panel is in the predetermined display mode, search and acquire the stored gamma corrected value of the first subpixels, and correct the gamma value of the gamma compensation circuit in accordance with the gamma corrected value; and the gamma compensation circuit is further configured to compensate for the first grayscale value of the first subpixels in the original image data in accordance with the corrected gamma value to acquire the second grayscale value.

* * * * *